US010349701B2

(12) United States Patent
Baltierra

(10) Patent No.: US 10,349,701 B2
(45) **Date of Patent: *Jul. 16, 2019**

(54) FOOTWEAR HAVING A SOLE FORMED WITH A CAVITY RECEIVING A HIGHLY VISCOUS GEL

(71) Applicant: Julie Baltierra, Fountain Valley, CA (US)

(72) Inventor: Julie Baltierra, Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/346,726

(22) Filed: Nov. 8, 2016

(65) Prior Publication Data

US 2017/0231323 A1 Aug. 17, 2017

Related U.S. Application Data

(63) Continuation-in-part of application No. 13/200,456, filed on Sep. 23, 2011, now Pat. No. 9,486,034.

(51) Int. Cl.

| | |
|---|---|
| ***A43B 7/14*** | (2006.01) |
| ***A43B 13/16*** | (2006.01) |
| ***A43B 13/18*** | (2006.01) |
| ***A43B 13/38*** | (2006.01) |
| ***A43B 13/40*** | (2006.01) |
| ***A43B 13/04*** | (2006.01) |
| ***A43B 5/10*** | (2006.01) |
| ***A43B 5/00*** | (2006.01) |

(Continued)

(52) U.S. Cl.

CPC ..... *A43B 13/189* (2013.01); *A43B 5/001* (2013.01); *A43B 5/008* (2013.01); *A43B 5/06* (2013.01); *A43B 5/10* (2013.01); *A43B 7/142* (2013.01); *A43B 7/148* (2013.01); *A43B 7/1425* (2013.01); *A43B 7/1445* (2013.01); *A43B 13/04* (2013.01); *A43B 13/16* (2013.01); *A43B 13/186* (2013.01); *A43B 13/188* (2013.01); *A43B 13/383* (2013.01); *A43B 13/40* (2013.01); *A43B 17/026* (2013.01)

(58) Field of Classification Search

CPC ..... A43B 13/02; A43B 13/141; A43B 13/16; A43B 13/187; A43B 13/188; A43B 13/189; A43B 17/003; A43B 17/006; A43B 17/026

USPC ..... 36/28, 30 R, 31, 43, 44, 88

See application file for complete search history.

(56) References Cited

U.S. PATENT DOCUMENTS 2,581,524 A * 1/1952 Ford ..... A43B 13/12 12/146 B 7,047,669 B2 5/2006 Polcek ..... 36/25 R (Continued)

*Primary Examiner* — Sharon M Prange

(57) ABSTRACT

A shoe support structure comprising a hard rubber-like material and a gel material. The rubber-like material is constructed so that it has a change in thickness beginning at the arch, where it slopes down, leveling out at a thickness of about 1¼ inches. This change in thickness creates a frontal recess, leaving a bead of rubber at the outer edge. This cavity holds a thick cushion of about 1¾ inches of highly viscous gel material held in place by the rubber lip and adhered to the elastic material. This creates a cushion when the foot applies weight. The front of the sole and the back of the heel are equal in height, giving the entire surface equal height planes for balance. The two materials are one rubber like, one gel like and slope toward each other at the arch in identical angles.

3 Claims, 5 Drawing Sheets

(51) Int. Cl.
*A43B 5/06* (2006.01)
*A43B 17/02* (2006.01)

(56) References Cited

U.S. PATENT DOCUMENTS

| | | | | |
|---|---|---|---|---|
| 7,284,342 | B2 | 10/2007 | Avent et al. | 36/44 |
| 8,333,023 | B2 | 12/2012 | Losio | 36/44 |
| 8,490,297 | B2 | 7/2013 | Guerra | 36/29 |
| 2005/0086838 | A1 | 4/2005 | Khantzis | 36/30 R |
| 2008/0244926 | A1* | 10/2008 | Yu | A43B 7/1415 36/28 |
| 2010/0139121 | A1 | 6/2010 | Geer et al. | 36/88 |

* cited by examiner

FOOTWEAR HAVING A SOLE FORMED WITH A CAVITY RECEIVING A HIGHLY VISCOUS GEL

CROSS-REFERENCES TO RELATED PATENT APPLICATIONS

This application claims is a continuation in part application of U.S. Non Provisional patent application Ser. No. 13/200,456 filed Sep. 23, 2011 which is incorporated herein by reference in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND

1. Field of the Invention

The present inventive subject matter relates to the field of footwear and more specifically to shoes having a uniquely configured sole with a cavity filled with a gel material to provide added comfort.

2. Background Art

Cushion pad inserts made of highly viscous gel-type material are known in the prior art. Proprietors of these prior art pads claim to provide the solution for tired and sore feet, alleging they relieve discomfort when placed inside any type of shoe. Many prior art inserts claim to provide additional padding for the ball of the foot when it has thinned out, for instance due to conditions of the wearer such as age, illness, or any one or more of many potential malformations of the foot. Many pad providers claim their inserts reduce pain and ease discomfort. Typical problems with insert types of soles is, as with anything inserted into a pre-fabricated shoe, they reduce the space inside the shoe and, in some cases, actually increase the pressure against the ball of the foot, toes or other foot problem areas.

Most shoes found in the prior art are designed to fit the foot securely and in most instances don't even allow for the additional comfort of a thicker sock. Consequently, typically manufactured shoes will not have the required room for sufficient padding to make a difference or to have additional space within the shoe to accommodate enough padding to make a difference to the wearer. They cause the wearer to lose needed room for the foot while at the same time cause pressure points which can result in blisters and circulation issues for the wearer.

Some wearers specifically seek additional padding, for instance to deal with conditions where the bones of the foot, such as those found in the arch, the area between the arch and the toes, or the toes themselves may be wrought with many conditions, resulting in some types of deformities in the structure of the foot. When adding insert padding, this limits the interior space in the front of the shoe, which then can cause pressure on these distorted areas of the toes or bones (which physically cannot lay straight or normal) and can cause blisters or sores from rubbing on the inside areas of shoes, such as the top and or sides of the shoe.

Other therapeutic shoes have laid claim to using additional types of cushioning material within the shoe or sole but the additional padding tends to be hidden somewhere deep within the shoe or constructed on the outside bottom surface of the shoe and the surface of the sole remains hard and in most typical applications unforgiving. Even if a softer material was used directly beneath a leather type sole, the benefit of the softer material does not comfort the foot as well as if the foot rested directly on the softer material with no interference.

SUMMARY

According to one aspect of the claimed subject matter, a shoe is provided that includes a sole having a heel in a customary supportive hard rubber-like material about 3 inches thick. The same rubber-like material surrounds the sole with a change in thickness beginning at the arch, where it slopes down, leveling out at a thickness of about 1¼ inches. This change in thickness creates a frontal recess or cavity, leaving a ring or bead of rubber at the outer edge. This cavity holds a thick cushion of about 1¾ inches of highly viscous gel material held in place by the rubber lip and adhered to the elastic material. This creates an unrestricted cushion when the foot applies weight during standing, walking or running. The front of the sole and the back of the heel are equal in height, giving the entire surface equal height planes for balance. The two materials are of different nature, one rubber like, one gel like and slope toward each other at the arch in identical angles. The gel material is on top of the rubber material at the arch, thus creating a smooth transition from one material to the other and they are bonded together at this juncture.

In several embodiments, the outer appearance of the shoe is typical, without any visual evidence of the interior. Only upon inspection or wearing of the shoe, does the interior become evident. One shoe sample in the form of a tennis shoe, comprises a canvas type upper material with eyelets and laces, commonly known as a tennis shoe, is only one non-limiting example or embodiment of the inventive subject matter. This novel insole design can be employed in any type shoe from bowling, golf, running, basketball, nursing, women's heels or any shoe where extreme padding is needed for comfort.

The deep cushion of many of the described embodiments allows space while at the same time allowing a wearer's deformed toes to sink lower into the sole upon stepping leading to a lower likelihood of the upper inside of the surface of the shoe rubbing the toes.

In one embodiment of the claimed subject matter, a shoe sole is comprised of a rubber material formed in a first layer, a gel material formed in a second layer positioned adjacent to said first layer; and an adhesive. The sole includes four portions: a heel portion, an arch portion, a front portion and a lip portion. The rubber material is positioned substantially along the entire length of the heel portion, the arch portion, and the front portion. In this embodiment, the lip portion is constructed of the rubber material and the heel portion is constructed of the rubber material. A thickness of the rubber material layer of the arch portion gradually decreases from a proximal end of the arch portion to a distal end of the arch portion, such that the thickness of the rubber material layer decreases from the heel portion to the front portion of the sole, creating a recess from the distal end of the arch portion of the sole portion to the proximate end of the front portion.

The recess is substantially ringed by the lip portion and the recess contains the gel material. In this embodiment, the sole is about 3 inches thick along an entire length of the sole and a thickness of the rubber material layer of said front portion is about 1.25 inches along said entire length of said front portion. The gel material fills the recess such that a thickness of the gel material layer is about 1.75 inches along the entire length of the front portion. The thickness of the gel material layer gradually decreases from the distal end of the arch portion to the proximal end of the arch portion such that the thickness of the gel material layer decreases from the front portion of the sole to the heel portion of the sole. The adhesive secures the gel material layer to a side of the rubber material layer. The arch portion is positioned between the heel portion and the sole portion and is substantially rectangular and the adhesive is configured to secure the gel material to the rubber material at the sole portion and the arch portion.

Also in this embodiment, the heel portion and the sole portion have a common surface lying substantially in a unitary plane. The rubber material of the heel portion extends to the sole portion. A thickness of the rubber material is constant at the heel portion and the sole portion. A thickness of the rubber material gradually decreases from a proximal end of the arch portion to a distal end of the arch portion, such that the thickness of the harder material decreases from the heel portion to the sole portion creating a recess from the distal end of the arch portion to the proximate end of the sole portion.

Other embodiments have a rubber-like material instead of a rubber material.

Other embodiments include a sole that is about 3 inches thick along an entire length of the sole. In these embodiments, a thickness of the rubber material layer of the front portion is less than 1.25 inches along the entire length of the front portion. The gel layer fills the recess such that a thickness of the gel layer is more than 1.75 inches along the entire length of the front portion. The thickness of the gel layer gradually decreases from the distal end of the arch portion to the proximal end of the arch portion, such that the thickness of the gel layer decreases from the front portion of the sole to the heel portion of the sole.

In other embodiments, the shoe sole is about 3 inches thick along an entire length of the sole. A thickness of the rubber material layer of the front portion is more than 1.25 inches along the entire length of the front portion. The gel layer fills the recess such that a thickness of the gel layer is less than 1.75 inches along the entire length of the front portion and the thickness of the gel layer gradually decreases from the distal end of the arch portion to the proximal end of the arch portion such that the thickness of the gel layer decreases from the front portion of the sole to the heel portion of the sole.

Both those with foot problems, as well as those without, will benefit from the embodiments described herein. As described in many of the embodiments, the pure comfort of extreme padding in the front of the shoe without the possibility of bottoming out, creates a feeling of standing, walking or running on pillows. For those that suffer from foot ailments such as calluses, hammer toe, bunions, bone spurs, thinning or destruction of the foot pad, the very thick padded area of the described embodiments, allows enough room for the foot as it presses into the gel, giving the wearer support while providing the room within the foot area of the shoe to alleviate pain.

DETAILED DESCRIPTION OF THE DRAWINGS

DETAILED DESCRIPTION OF THE EMBODIMENTS

Figure 1:
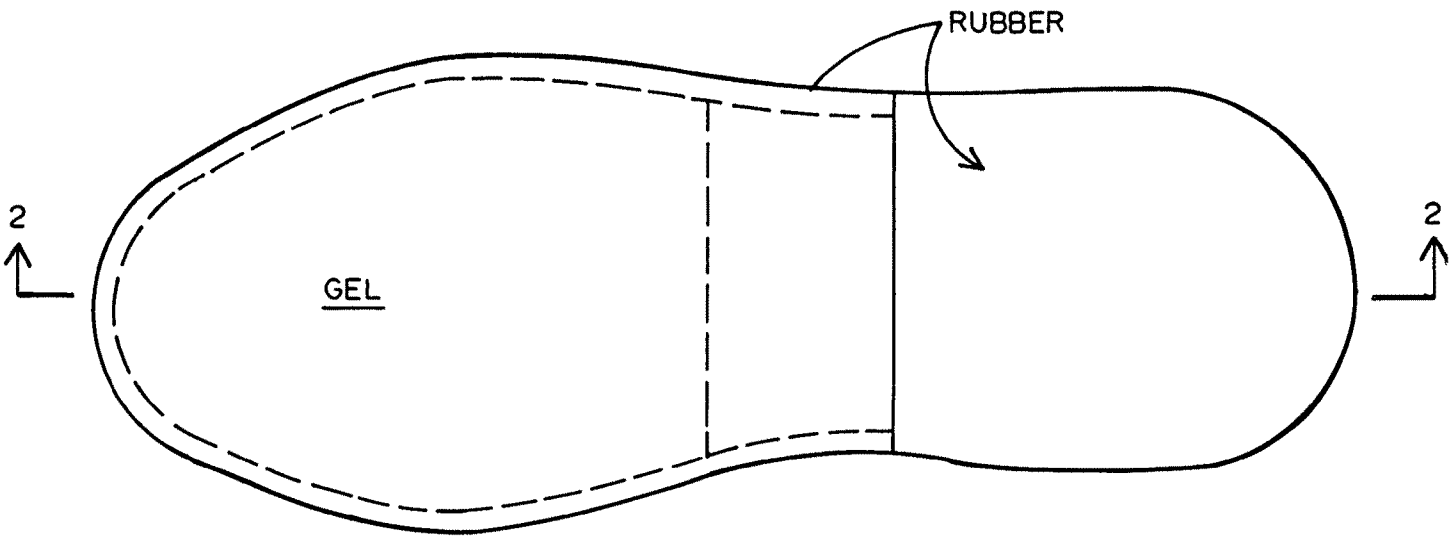
FIG. 1 is a top view of the foot support structure of a preferred embodiment of the invention.

According to embodiments of the claimed subject matter, various soles, insoles and methods of fabricating soles and insoles are provided and may be generally described with the reference to FIGS. 1-6 showing, but not limited to, certain exemplary embodiments of the inventive subject matter.

Referring now to the accompanying drawings, it will be seen that an exemplary embodiment of the present claimed subject matter is shown as used in a sports shoe commonly referred to as a sneaker. In the conventional sneaker, the entire foot support structure (the sole or insole) is typically made of rubber or a rubber-like material. In the present invention, the term "sole" refers to support structures that are included with the shoe during manufacturing and the term "insole" refers to support structures that are used to replace the foot support structures of previously manufactured shoes.

In the present embodiments, the foot support structure, a sole or insole structure as used with a shoe, has a compound configuration made of two different materials, namely a rubber material and a gel material. The rubber material can be made of rubber or of any suitable rubber blend known to those skilled in the art which would result in rubber like characteristics. Similarly, the gel material may be made of any gel type of compound known to those skilled in the art. The rubber and gel materials can also be combined in various configurations, for example 40% rubber and 60% gel, 30% rubber and 70% gel, 70% rubber and 30% gel or the two materials may be combined together or with another material in any other combination suitable to those skilled in the art.

In the heel region of the described embodiments, the sole or insole support structure remains rubber or rubber-like material throughout the entire thickness of the structure. However, in the sole region where the arch, ball of the foot, metatarsal bones and the phalanges (the toe bones), the rubber material thickness is reduced to less than half of the overall thickness of the support structure allowing the formation of a large recess. This recess receives a gel material. The characteristics of the gel material make it much softer and more compressible than the rubber or rubber-like material. In several embodiments, such as those used with a sneaker-type sports shoe, the gel is a silicone gel or viscoelastic urethane polymer having a durometer of about 10 on the Shore-OOO scale to 50 on the Shore-A scale.

The recess for accommodating the gel is formed from the rubber that constitutes the conventional sneaker heel. In many of the embodiments, the recess is formed integral to the sole but, in other embodiments, the recess may be formed in an insole placed within the shoe over the sole. In several embodiments using a tennis or sneaker type of shoe, an exemplary sole integrated within the shoes can have a total thickness of approximately three inches. The thickness can also be greater, such as 4, 6 or 8 inches or it can be less, such as 0.2, 0.5, 1 or 2 inches. In these embodiments, all or a large portion of the heel region thickness is made up of the standard hard rubber material which can typically be found in sneakers. In many of these embodiments, the rubber forms only the bottom 40% to 45% of the three-inch-thick sole and the top 55% to 60% of the sole is formed from the gel material. In other embodiments, the rubber may form less than 40% or more than 45% and the gel may occupy less than 55% or more than 60% of the volume of the sole.

Also in these embodiments, in order to provide structural support for the gel, the rubber material forms a small bead partially surrounding the entire perimeter of the recess receiving the gel. The bead would typically be about ¼ inch in height above the full layer of rubber which provides a platform in the recess for receiving the gel layer residing in the recess. The bead could be higher or lower depending on the desired configuration of the rubber material/gel material combination and whether or not any other materials are also used with the rubber material/gel material combination. For instance, the bead could be ⅛ inch in height, ⅓ inch in height or 2 inches in height. Many of the embodiments may include soles and insoles using the aforementioned combinations of materials for other types of shoes including other types of athletic and non-athletic shoes such as dress shoes for men and women.

Figure 2:
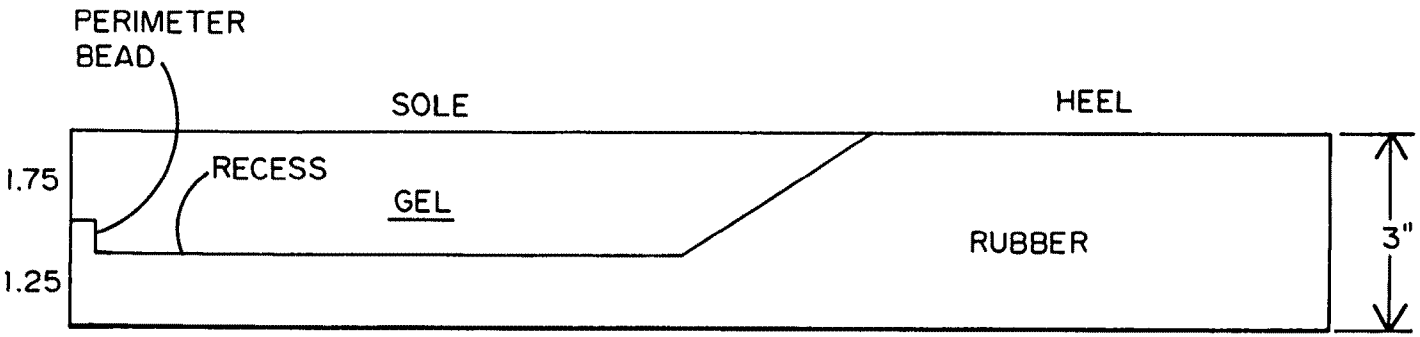
FIG. 2 is a cross-sectional view of the foot support structure taken along lines 2-2 of FIG. 1.
Figure 3:
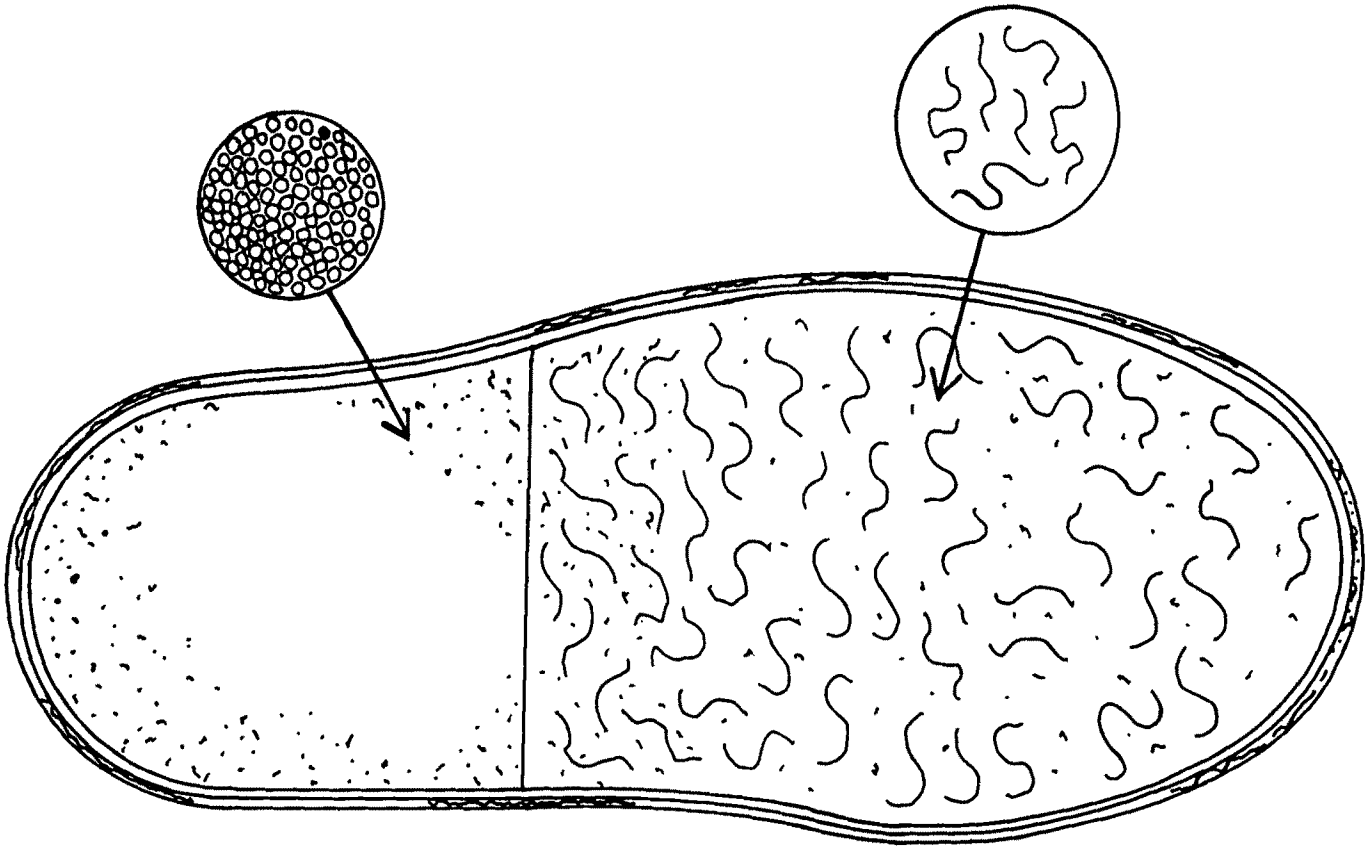
FIG. 3 is a top view similar to the view shown in FIG. 1, but showing the respective materials used to form the heel and sole portions of the preferred embodiments.
Figure 4:
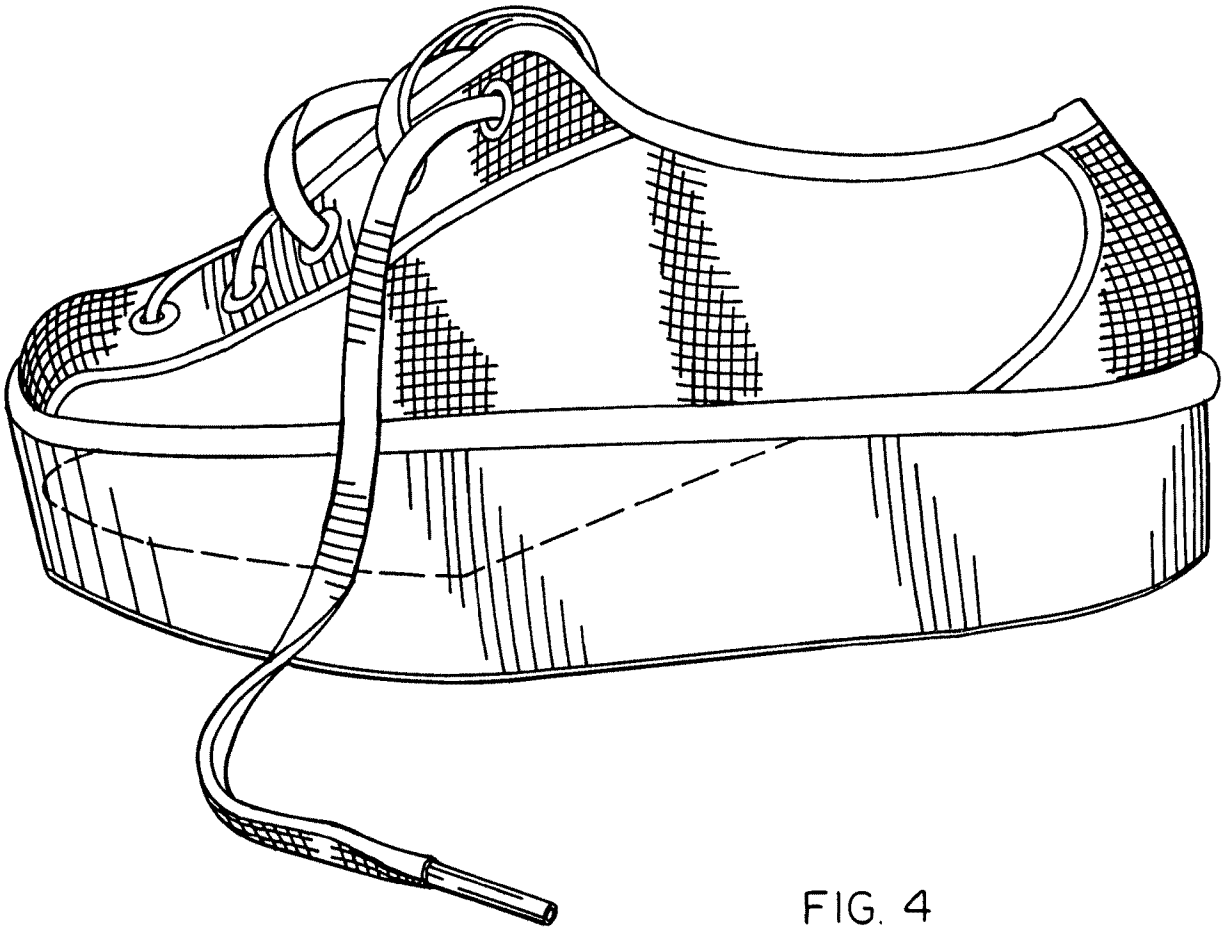
FIG. 4 is a left-side view of the entire shoe in which the foot support structure of FIG. 1 is employed.
Figure 5:
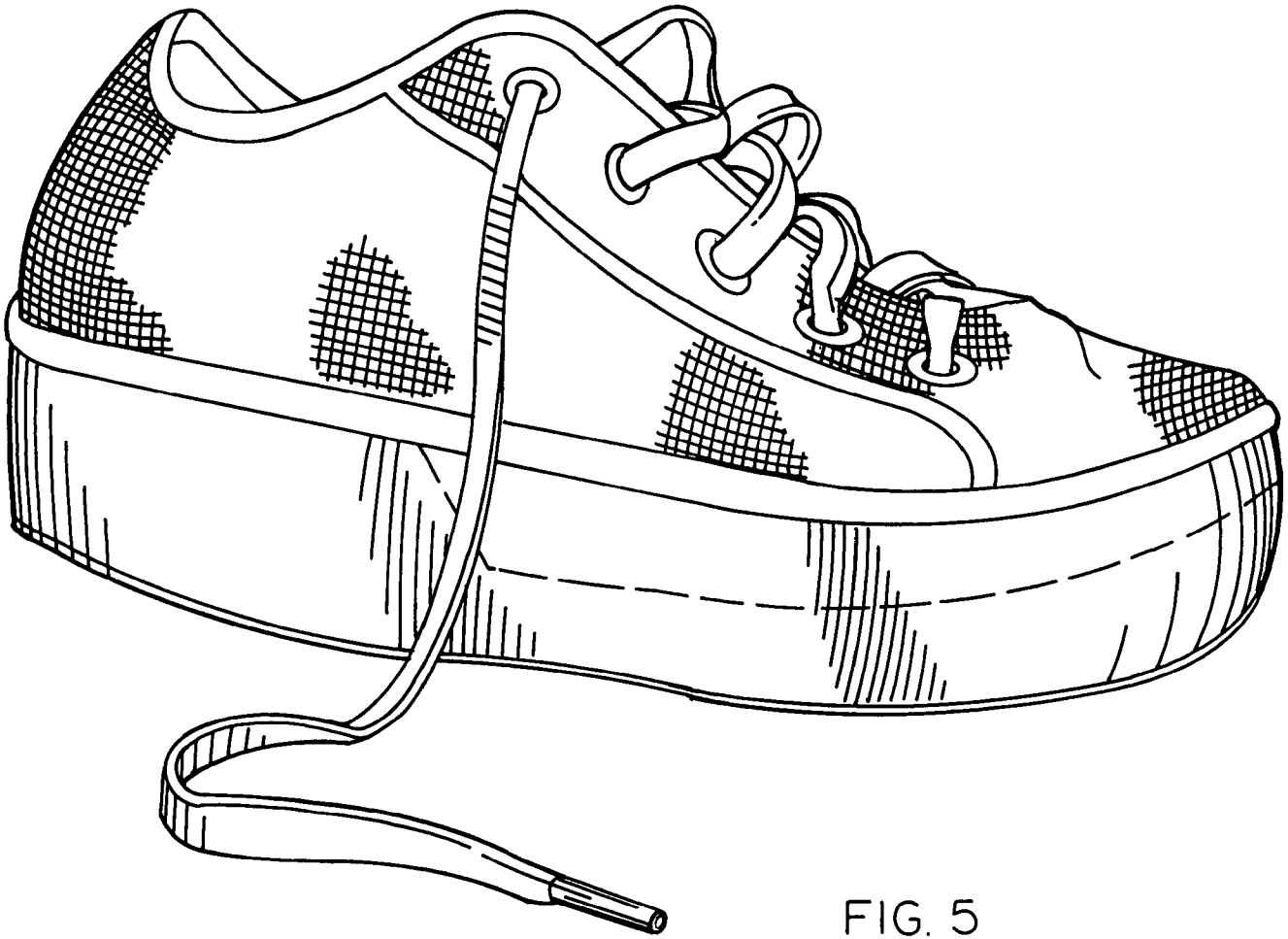
FIG. 5 is a right-side view of the show of FIG. 4.
Figure 6:
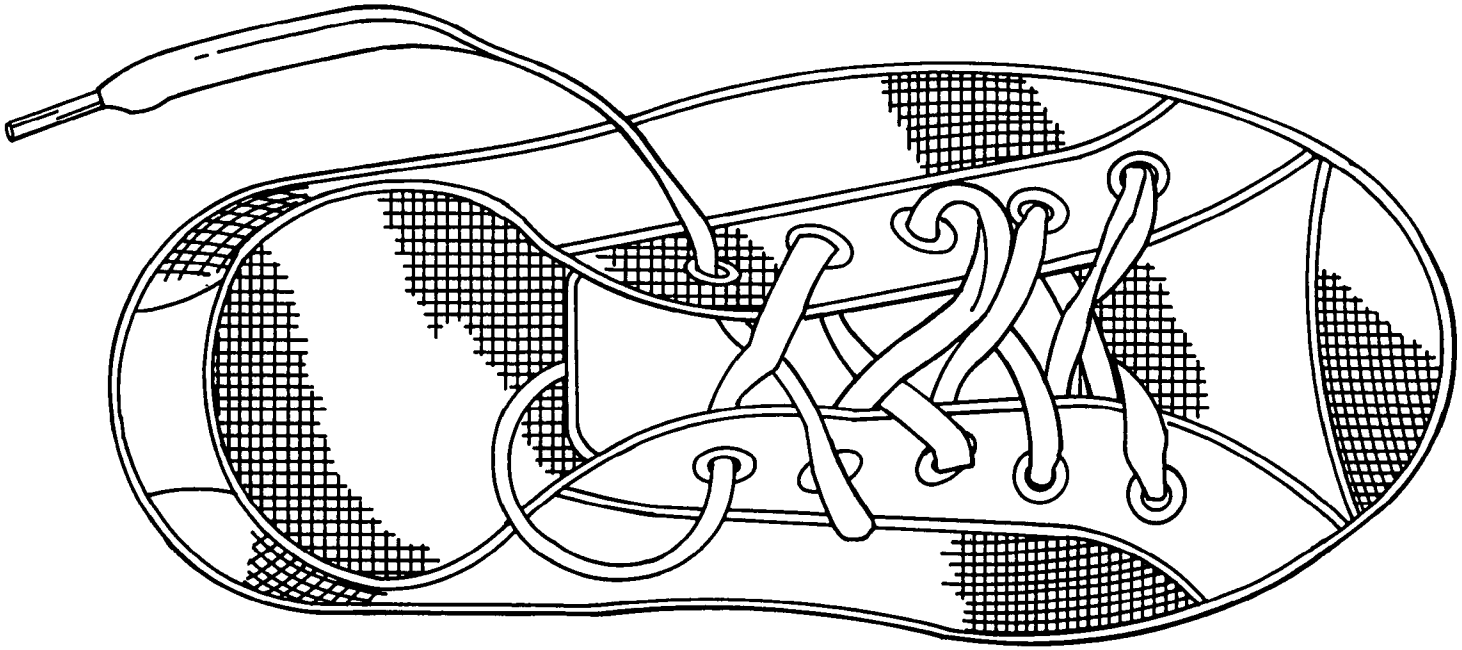
FIG. 6 is a top view of the shoe of FIG. 4.

In many of the described embodiments, the transition between the all-rubber heel and the gel/rubber sole, occurs at the arch region of the sneaker where the thickness of the gel is diminished linearly over about a 2 to 3-inch length along the axis of the sneaker as shown for example in FIGS. 1 and 2. The area with overlap between gel and rubber can be coated with a suitable adhesive to secure the gel to the rubber although any other method of fastening such as heat sealing may be used. In addition, the respective thicknesses are carefully controlled to maintain a relatively flat sole surface (or insole surface if an insole is used) for promoting foot comfort and balance. In other embodiments, the sole surface (or insole surface if the embodiment is an insole rather than a sole) can be inclined or declined as desired.

As used in these embodiments, the rubber like material in the heel region is a harder layer used to provide stability for the wearer allowing the wearer to balance when stepping, standing or running. For instance, when the heel or the toe initially contact the surface at the heel, that impact area bears the entire weight of the wearer's body so it needs to be stable. The step continues to roll across the gel leading to a downward pressure on the remainder of the upper surface of the support structure. When the wearer is standing, the balance of the weight is at the heel, not in the front of the foot so any unstable material in the heel area of the shoe may cause instability. Impacts from walking or running can lead to stress and potential injury to the ankle or leg.

There are a variety of rubber-like materials that can be used in place of rubber. These rubber-like materials offer a variety of elastomer characteristics including Shore scale A hardness, elongation at break, tear resistance and tensile strength.

In the drawings, a tennis shoe or sneaker is illustrated but any type of shoe may be used with embodiments of the present claimed subject matter. As previously mentioned, the foot support structure (insole or sole) can have various thicknesses and shapes depending on the structure of the shoe. Any suitable thickness and shape may be used.

It will now be understood that the embodiments of the claimed subject matter relate to use of a relatively thick layer of gel material in the front or sole portion of an insole where it resides in a recess formed from a more conventional rubber or rubber-like material configured as the heel portion and the remainder of the insole. It is believed that the novelty of the inventive subject matter herein resides primarily in the use of such a thick gel portion throughout the sole region of the foot support structure while nevertheless retaining a relatively planar insole surface that provides a user with a sense of balance and a high degree of comfort. However, the scope hereof is limited only by the appended claims.

I claim:

1. A shoe sole comprised of:

a rubber material formed in a first layer;

a gel material formed in a second layer positioned adjacent to said first layer; and an adhesive;

wherein said sole includes four portions: a heel portion, an arch portion, a front portion and a lip portion;

wherein said rubber material is positioned substantially along an entire length of said heel portion, said arch portion, and said front portion;

wherein said lip portion is constructed of said rubber material;

wherein said heel portion is constructed of said rubber material;

wherein a thickness of said rubber material layer of said arch portion gradually decreases from a proximal end of said arch portion to a distal end of said arch portion, such that said thickness of said rubber material layer decreases from said heel portion to said front portion of said sole, creating a recess from said distal end of said arch portion of said sole to a proximal end of said front portion;

wherein said recess is substantially ringed by said lip portion; and wherein said recess comprises said gel material;

wherein said sole is about 3 inches thick along an entire length of said sole;

wherein a thickness of said rubber material layer of said front portion is about 1.25 inches along an entire length of said front portion;

wherein said gel material fills said recess such that a thickness of said gel material layer is about 1.75 inches along said entire length of said front portion and wherein said thickness of said gel material layer gradually decreases from said distal end of said arch portion to said proximal end of said arch portion such that said thickness of said gel material layer decreases from said front portion of said sole to said heel portion of said sole; and wherein said adhesive secures said gel material layer to a side of said rubber material layer;

wherein said arch portion is positioned between said heel portion and said sole portion and is substantially rectangular;

wherein said adhesive is configured to secure said gel material to said rubber material at said front portion and said arch portion;

wherein said heel portion and said front portion have a common surface lying substantially in a unitary plane;

wherein said rubber material of said heel portion extends to said front portion;

wherein a thickness of said rubber material is constant at said heel portion and said front portion.

2. A shoe sole comprised of:

a rubber material formed in a first layer;

a gel material formed in a second layer positioned adjacent to said first layer; and an adhesive;

wherein said sole includes four portions: a heel portion, an arch portion, a front portion and a lip portion;

wherein said rubber material is positioned substantially along an entire length of said heel portion, said arch portion, and said front portion;

wherein said lip portion is constructed of said rubber material;

wherein said heel portion is constructed of said rubber material;

wherein a thickness of said rubber material layer of said arch portion gradually decreases from a proximal end of said arch portion to a distal end of said arch portion, such that said thickness of said rubber material layer decreases from said heel portion to said front portion of said sole, creating a recess from said distal end of the said arch portion of said sole to a proximal end of said front portion;

wherein said recess is substantially ringed by said lip portion; and wherein said recess comprises said gel material;

wherein said sole is about 3 inches thick along an entire length of said sole;

wherein the thickness of said rubber material layer of said front portion is less than 1.25 inches along said entire length of said front portion;

and wherein said gel layer fills said recess, such that a thickness of said gel layer is more than 1.75 inches along said entire length of said front portion and wherein said thickness of said gel layer gradually decreases from said distal end of said arch portion to said proximal end of said arch portion, such that said thickness of said gel layer decreases from said front portion of said sole to said heel portion of said sole;

wherein said adhesive secures said gel material layer to a side of said rubber material layer;

wherein said arch portion is positioned between said heel portion and said sole portion and is substantially rectangular;

wherein said adhesive is configured to secure said gel material to said rubber material at said front portion and said arch portion;

wherein said heel portion and said front portion have a common surface lying substantially in a unitary plane;

wherein said rubber material of said heel portion extends to said front portion;

wherein a thickness of said rubber material is constant at said heel portion and said front portion.

3. A shoe sole comprised of:

a rubber material formed in a first layer;

a gel material formed in a second layer positioned adjacent to said first layer; and an adhesive;

wherein said sole includes four portions: a heel portion, an arch portion, a front portion and a lip portion;

wherein said rubber material is positioned substantially along an entire length of said heel portion, said arch portion, and said front portion;

wherein said lip portion is constructed of said rubber material;

wherein said heel portion is constructed of said rubber material;

wherein a thickness of said rubber material layer of said arch portion gradually decreases from a proximal end of said arch portion to a distal end of said arch portion, such that said thickness of said rubber material layer decreases from said heel portion to said front portion of said sole, creating a recess from said distal end of the said arch portion of said sole to a proximal end of said front portion;

wherein said recess is substantially ringed by said lip portion; and wherein said recess comprises said gel material;

wherein said sole is about 3 inches thick along an entire length of said sole;

wherein the thickness of said rubber material layer of said front portion is more than 1.25 inches along said entire length of said front portion;

and wherein said gel layer fills said recess, such that a thickness of said gel layer is less than 1.75 inches along said entire length of said front portion and wherein said thickness of said gel layer gradually decreases from said distal end of said arch portion to said proximal end of said arch portion;

wherein said adhesive secures said gel material layer to a side of said rubber material layer;

wherein said arch portion is positioned between said heel portion and said sole portion and is substantially rectangular;

wherein said adhesive is configured to secure said gel material to said rubber material at said front portion and said arch portion;

wherein said heel portion and said front portion have a common surface lying substantially in a unitary plane;

wherein said rubber material of said heel portion extends to said front portion;

wherein a thickness of said rubber material is constant at said heel portion and said front portion.

* * * * *